US007817934B2

(12) United States Patent
Naoi et al.

(10) Patent No.: US 7,817,934 B2
(45) Date of Patent: Oct. 19, 2010

(54) IMAGE FORMING APPARATUS WITH POWER SAVING SLEEP MODE

(75) Inventors: Hiroo Naoi, Nara (JP); Mitsuru Tokuyama, Kizugawa (JP); Kohichi Takenouchi, Tenri (JP); Kiyofumi Morimoto, Tenri (JP); Kazuma Hinoue, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 228 days.

(21) Appl. No.: 12/135,531

(22) Filed: Jun. 9, 2008

(65) Prior Publication Data

US 2009/0010662 A1 Jan. 8, 2009

(30) Foreign Application Priority Data

Jul. 2, 2007 (JP) ..... 2007-173785

(51) Int. Cl.
*G03G 15/00* (2006.01)
*G03G 21/00* (2006.01)
*G03G 15/20* (2006.01)

(52) U.S. Cl. ..... 399/75; 399/44; 399/69

(58) Field of Classification Search ..... 399/44, 399/55, 69, 75, 76, 77, 78
See application file for complete search history.

(56) References Cited

U.S. PATENT DOCUMENTS 5,589,923 A * 12/1996 Lee et al. ..... 399/78
5,966,557 A 10/1999 Wada ..... 399/43
6,577,825 B1 * 6/2003 Gonnella et al. ..... 399/75 X
6,917,772 B2 7/2005 Hoshika
7,266,315 B2 * 9/2007 Sato ..... 399/75 X
7,580,651 B2 * 8/2009 Namizuka et al. ..... 399/75
7,593,291 B2 * 9/2009 Ito ..... 399/77 X
2003/0026623 A1 2/2003 Hoshika

FOREIGN PATENT DOCUMENTS

JP 6-27961 B2 4/1994
JP 8-171242 A 7/1996
JP 11-160921 6/1999
JP 2003-35979 A 2/2003
JP 2003-177638 6/2003
JP 2003-345180 A 12/2003
JP 2004-45605 A 2/2004
JP 2004-90457 A 3/2004

* cited by examiner

*Primary Examiner*—Sandra L Brase
(74) *Attorney, Agent, or Firm*—Nixon & Vanderhye, PC

(57) ABSTRACT

An image forming apparatus that includes: an image forming portion for forming an image in accordance with image data contained in an input command; and a controller for controlling the image forming portion, and is constructed such that the controller includes: a mode switch for switching the image forming portion from a standby mode in which image forming is instantly enabled into a power-saving mode in which power supply to the image forming portion is partially stopped when no subsequent command has been received after a predetermined period elapsed from when image forming portion was operated last; a mode restoring portion for restoring the image forming portion from power-saving mode to standby mode when a subsequent command is received; and an image quality controller for performing image quality control of the image every time a predetermined time elapsed from when the image forming portion was last operated, and the image quality controller starts execution of the image quality control before the mode restoring portion restores the image forming portion from the power-saving mode to the standby mode.

10 Claims, 11 Drawing Sheets

FIG. 7

Table showing the agitation performance and conveyance performance depending on the arrangement of fins shown in FIG. 6

| | Type I FIG.6A | Type II FIG.6B | Type III FIG6C | Type IV FIG.6D | Type V FIG.6E |
|---|---|---|---|---|---|
| Agitation performance | × | ○ | △ | × | ○ |
| Conveyance performance | ○ | × | △ | △ | △ |

○ : Good
△ : Fair
× : Bad

IMAGE FORMING APPARATUS WITH POWER SAVING SLEEP MODE

This Nonprovisional application claims priority under 35 U.S.C. §119(a) on Patent Application No. 2007-173785 filed in Japan on 2 Jul. 2007, the entire contents of which are hereby incorporated by reference.

BACKGROUND OF THE TECHNOLOGY (1) Field of the Technology

The present technology relates to an image forming apparatus based on electrophotography, a static recording technique or the like, such as a copier, facsimile machine, printer, so-called multi functional peripheral having these functions or the like, in particular relating to operational control when the image forming apparatus is recovered from a power saving mode such as sleep mode or the like to standby mode for printout operations.

(2) Description of the Prior Art

As the image forming apparatus that acquires image data by receipt from without or by document reading and the like and produces printout of the image data after various image processes, so-called multi functional peripherals (MFPs) having basic functions such as printer, scanner, facsimile and copier functions and also other various functions using network communications have been widely used. Such MFPs are mostly shut down during the night by cutting off the main supply to the apparatus for safety, power-saving and other reasons while they usually have power-saving mode in which the necessary minimum MFP functionality can operate in consideration of FAX reception. This power-saving mode is also called as sleep mode, and is a mode in which functional systems such as fuser, driver and other systems and display of the control portion are turned off or in which power supply to the necessary minimum functional portions as an image forming apparatus, such as an input recognition system for external input lines and particular switches alone is turned on, so as to recover the standby mode when some activating event such as facsimile reception occurs. When the image forming apparatus restores itself into the standby mode for a printing operation from this power saving mode or after an interruption due to some operational trouble of the apparatus and other reasons, there occurs a case in which images to be output are disrupted, needing a control for stabilizing the output images.

As an image forming apparatus that performs image stabilizing control to achieve high quality image forming when recovering from power saving mode to standby mode, there is a known configuration disclosed in patent document 1 (Japanese Patent Application Laid-open Hei 11-160921) in which image stabilizing control is performed when it is necessary while the control is omitted to shorten the waiting time when it is unnecessary. Patent document 1 discloses a density control method in an image forming apparatus that is characterized in that an image density control operation is performed after completion of a warm-up operation that is started when its main power supply is turned on or its sleep mode is cancelled.

On the other hand, patent document 2 (Japanese Patent Application Laid-open 2003-177638) discloses an image forming apparatus in which the density control factors that affect image density are optimized. Specifically, the image forming apparatus is constructed so as to perform one processing mode selectively from a plurality of processing modes having different numbers of steps as the processing modes for optimizing density control factors and it also determines whether a criterion regarding the status change of the apparatus is satisfied or not and performs selectively one processing mode from the plurality of processing modes based on the determined result.

However, in any of the image forming apparatus in accordance with the aforementioned conventional technologies, image quality control mode for obtaining desirable print quality has to be performed after recovery from sleep mode. Accordingly, though the output print quality can be assured, the density control process and/or other operational processes need to be inserted every time of recovery from sleep mode, so that it takes time to obtain the first printout. As a result, for users who do not often perform printing operations, it took a rather long time for image quality control every time the apparatus was recovered from its sleep mode, hence there occurred the problem that the productivity of the printing operation would be markedly degraded.

SUMMARY OF THE TECHNOLOGY

The present technology has been devised in view of the above problem entailed with the conventional image forming apparatus, it is therefore an object to provide a novel and improved image forming apparatus which can complete a recovery operation from sleep mode or energy save mode without performing a process control upon recovery to thereby shorten the time from recovery to completion of printout.

In order to achieve the above object, one aspect of the present technology provides an image forming apparatus that can be operated in a plurality of power modes different in power consumption, comprising: an image forming portion for forming a visual image in accordance with image data contained in an input command; and a controller for controlling the image forming portion, and being characterized in that the controller includes: a mode switch for switching the image forming portion from a standby mode in which image forming is instantly enabled into a power-saving mode in which power supply to the image forming portion is partially stopped when no subsequent command has been received after a predetermined period has elapsed from when image forming portion was operated last; a mode restoring portion for restoring the image forming portion from the power-saving mode to the standby mode when a subsequent command is received; and an image quality controller for performing image quality control of the visual image every predetermined time from when the operation of the image forming portion last ended, and the image quality controller starts execution of the image quality control before the mode restoring portion restores the image forming portion from the power-saving mode to the standby mode.

With the above configuration, image quality control for boosting up the image forming process is effected during sleep mode as a power-saving mode, so that it is possible to start an image forming operation immediately after recovery from sleep mode, whereby it is possible to shorten the time from the recovery from sleep mode to the first printout.

In the above configuration, the mode switch, the mode restoring portion and the image quality controller may be operated based on the output data from a time counter for counting the length of lapse time from when the image forming portion was last operated.

With the above configuration, switch to the power saving mode, recovery from the save energy mode and operation of image quality control are set up based on the timer (lapse-time counter) as a time counter, so that it is possible to simply shorten the time from recovery from sleep mode to the first printout in accordance with the output data from a single time counter.

In the above configuration, the status of image forming when the image forming portion is recovered from the power-saving mode to the standby mode by the mode restoring portion may be set with the conditions that were designated for the image quality control immediately before the recovery.

When the status of image forming at the time of recovery from sleep mode is designated as above, it is possible to perform image quality control as many cycles as possible during sleep mode before recovery from sleep mode, it is possible to reduce the time from recovery from sleep mode to the first printout because a greater part of the image quality control process can be omitted.

When the visual image formed by the image forming portion is a color image, the above configuration may be adapted such that the image quality controller effects image quality control on every visual image formed based on the image data corresponding to each of the separated colors of the color image, first and then the mode restoring portion restores the image forming portion from the power-saving mode to the standby mode.

To perform color image forming which needs a longer time, it is possible to shorten most of the time required for the image quality control process, it is hence possible to shorten the time from recovery from sleep mode to first printout to as low as the level for monochrome images.

The above configuration may be adapted such that the image forming portion comprises: an image bearer on which a latent image is formed by a light exposure device; a developer support for conveying a developer containing an electrostatically chargeable toner to the image bearer with a latent image; and a bias voltage applicator for applying an oscillating bias which periodically alternate the developing potential that causes the toner to transfer from developer support to the image bearer and the inverse developing potential that causes the toner to transfer from the image bearer to the developer support, to the developer support, when the amount of change in the developing potential exceeds a threshold, the image quality controller shortens the predetermined time for start of performing the image quality control during the power saving mode.

In this way, the developing potential that has a large influence on image quality is detected during sleep mode and the predetermined time up to start of image quality control during sleep mode is modified depending on the amount of change in the developing potential. Accordingly, it is possible to achieve image quality control more frequently in a more exact manner.

The above configuration may further include: a fusing unit for fixing the visual image that was formed by the image forming portion and transferred to a recording medium, to the recording medium, and may be adapted such that the fusing unit comprises: a heat roller having a heat generator therein; a pressing roller put in pressing contact with the heat roller; and a surface temperature detector for detecting the atmosphere inside the image forming apparatus and the surface temperature of the heat roller, and when the amount of change in the surface temperature during the power-saving mode exceeds a threshold, the predetermined time for start of the image quality control is shortened.

Since the flow and agitation performance of the developer is improved as the temperature inside the image forming apparatus increases, the toner can be mixed with the developer more easily. Accordingly, the developing performance of the developer is improved in appearance so that the developer can easily bring out expected image density. In this way, image quality control can be achieved while considering the electrostatic charge performance of the developer that has a large influence on image quality, or by appropriately grasping the conditions under which the apparatus has been left during sleep mode, hence it is possible to effect exact image quality control more frequently.

In the above configuration, the image forming apparatus may further comprise a humidity detector for detecting humidity, and the predetermined time for start of the image quality control may be shortened when the amount of change in the humidity during the power-saving mode exceeds a threshold.

When the humidity inside the image forming apparatus increases, tribo-chargeability lowers hence the amount of charge on the toner lowers. Accordingly, if the developing potential is set at the same level, the toner becomes prone to transfer and produce the expected image density though background fogging is also likely to occur. In this way, image quality control can be achieved in consideration of the humidity, one of the factors to vary the tribo-chargeability of the developer that has a large influence on image quality, or by appropriately grasping the conditions under which the apparatus has been left during sleep mode, hence it is possible to effect more exact image quality control.

In the above configuration, a boosting operation of the surface temperature may be performed in the fusing unit when the surface temperature is equal to or lower than the predetermined temperature during the power-saving mode.

With this configuration and more particularly the problem that needs the longest time for recovery from sleep mode can be suppressed so as to inhibit influence on the image quality due to insufficiency of the fixing temperature, hence it is possible to secure the first printout.

The above configuration may further includes a warning display portion for displaying a warning when the amount of change in the developing potential exceeds a threshold in the image quality control during the power-saving mode.

With this configuration, it is possible to inform low-volume users that it will take a long time to produce the first printout and gain their understanding.

As has been described, since image quality control as the boost up operation of an image forming process from a sleep mode can be effected during the sleep mode, an image forming operation can be started immediately after the recovery. As a result it is possible to shorten the first printout time after recovery from sleep mode, hence the user does not need to wait to have printout.

BRIEF DESCRIPTION OF THE DRAWINGS

FIG. 7 is a table showing the agitation performance and conveyance performance in each example shown in FIG. 6;

DESCRIPTION OF THE PREFERRED EMBODIMENTS

Figure 1:
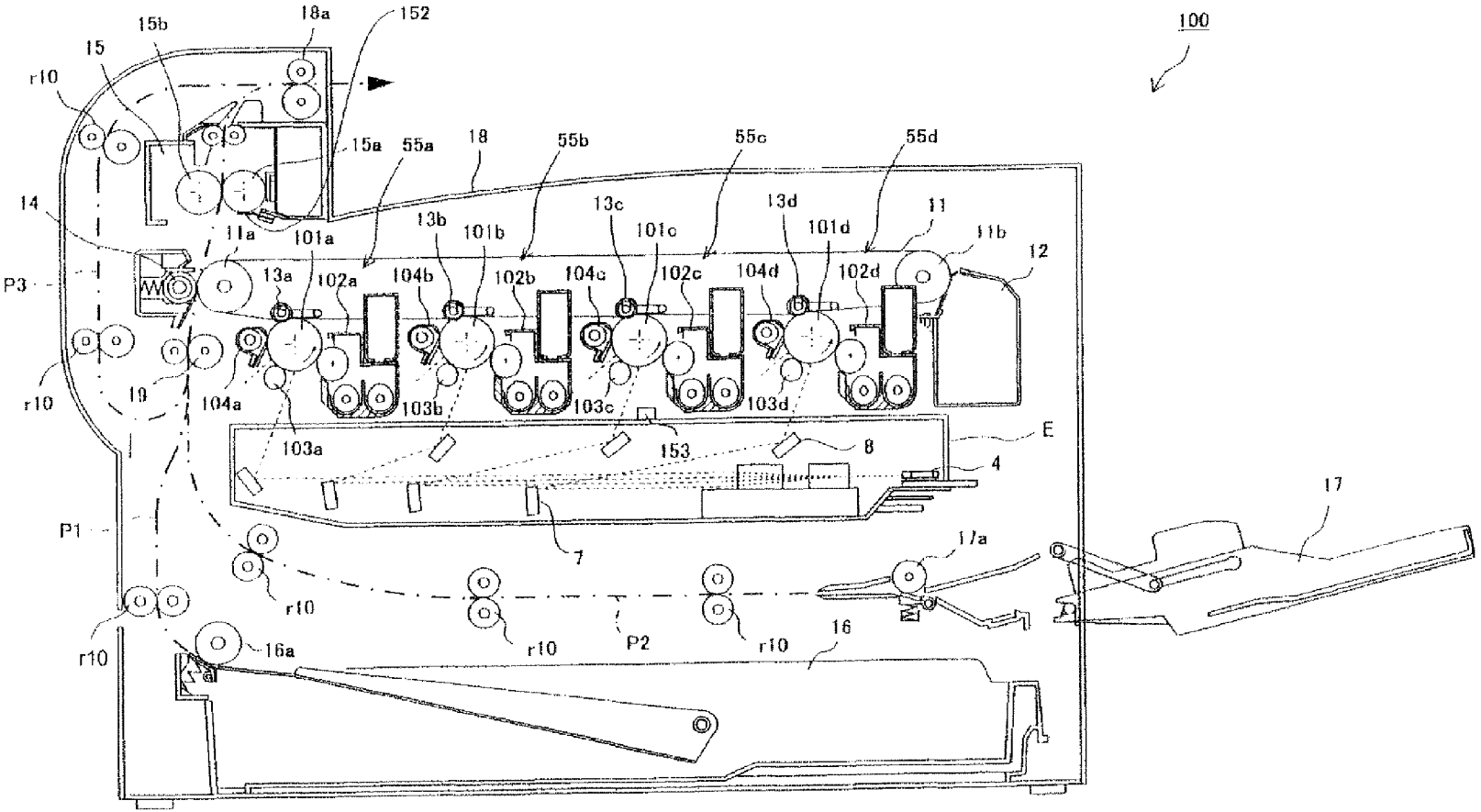
FIG. 1 is an illustrative view showing an overall configuration of the first embodiment of an image forming apparatus.

The preferred embodiment of this technology will hereinafter be described in detail with reference to the accompanying drawings. Here, in this description and the drawings, the components having essentially the same functionality are allotted with the same reference numerals to avoid repeated description.

The First Embodiment

To begin with, the configuration of the first embodiment of an image forming apparatus will be described with reference to the drawings. FIG. 1 is an illustrative view showing an overall configuration of the first embodiment of an image forming apparatus.

Image forming apparatus 100 forms a visual image printout of a multi-colored or monochrome image on a predetermined sheet (recording paper) in accordance with image data contained in an input command, such as image data and the like transmitted from without by way of a communication network or the like. Image forming apparatus 100 of the present embodiment includes: as shown in FIG. 1, an exposure unit E; photoreceptor drums 101 (101*a* to 101*d*) corresponding to image bearers on which latent images are formed by the exposure unit E; developing units 102 (102*a* to 102*d*); charging rollers 103 (103*a* to 103*d*); cleaning units 104 (104*a* to 104*d*); an intermediate transfer belt 11; primary transfer rollers 13 (13*a* to 13*d*); a secondary transfer roller 14; a fuser unit 15; paper feed paths P1, P2 and P3; a paper feed cassette 16; a manual paper feed tray 17; and a paper output tray 18.

The image data for a color image handled in image forming apparatus 100 of the present embodiment is formed of image data of four colors, i.e., black (K), cyan (C), magenta (M) and yellow (Y), and separate image forming portions 55 (55*a* to 55*d*) form visual images of different colors. Accordingly, four developing units 102 (102*a* to 102*d*), photoreceptor drums 101 (101*a* to 101*d*), charging rollers 103 (103*a* to 103*d*) and cleaning units 104 (104*a* to 104*d*) for forming four latent images for four different colors are provided.

All the image forming portions 55*a* to 55*d* have the same configurations, for example black image forming portion 55*a* is composed of, photoreceptor drum 101*a*, developing unit 102*a*, charging roller 103*a*, transfer roller 13*a* and cleaning unit 104*a* and the like. The image forming portions 55*a* to 55*d* are arranged in a row in the intermediate transfer belt 11's direction of movement (sub scan direction). Here, the symbols a to d are used so that 'a' corresponds to black, 'b' to cyan, 'c' to magenta and 'd' to yellow. The devices designated by each symbol form one imaging station, that is, four imaging stations are provided. In the present embodiment, a temperature and humidity detecting sensor 153 for detecting the atmospheric temperature and humidity inside image forming apparatus 100 is arranged under these image forming portions 55*a* to 55*d*, as shown in FIG. 1. Here, the temperature and humidity detecting sensor 153 may be arranged at another position inside the apparatus as long as it can detect the atmospheric temperature and humidity inside the machine.

The image forming apparatus of the present embodiment has a function that, when no following command such as a print job or the like from an external terminal has been detected for a predetermined period after the time the image forming portions 55*a* to 55*d* had their final operation, it switches the image forming portions 55*a* to 55*d* from standby mode in which image forming with image forming portions 55*a* to 55*d* can be immediately started, to sleep mode as a power-saving mode in which power supply to image forming portions 55*a* to 55*d* is partially stopped. The apparatus restores image forming portions 55*a* to 55*d* from sleep mode to standby mode when a following command is detected during the sleep mode. Switching of image forming portions 55*a* to 55*d* into sleep mode and the operation of recovery therefrom in the present embodiment will be detailed later.

Exposure unit E as the light exposure device in the present embodiment includes an unillustrated semiconductor laser, a polygon mirror 4, a first reflecting mirror 7 and a second reflecting mirror 8, and illuminates photoreceptor drums 101*a* to 101*d* with light beams, i.e., laser beams, that are modulated based on image data of separate colors, that is, black, cyan, magenta and yellow. Formed on photoreceptor drums 101*a* to 101*d* are electrostatic latent images based on image data of respective colors of black, cyan, magenta and yellow. Though exposure unit E of the present embodiment is based on a technique using a laser scanning unit (LSU) equipped with a laser emitter and reflection mirrors, other methods using an array of light emitting elements such as an EL or LED writing head, for example may be used instead.

Photoreceptor drum 101 is an essentially cylindrical image bearer, which is arranged above exposure unit E, and is controlled by unillustrated driving device and control device so as to rotate in a predetermined direction. Photoreceptor drum 101 is composed of a base member and a photoconductive layer formed thereon. For example, the photoreceptor drum may be formed of a metallic base drum of aluminum or the like and a thin film of a photo conductive layer of amorphous silicon (a-Si), selenium (Se), organic photoconductor (OPC) or the like, formed on the outer peripheral surface of the base member. The configuration of photoreceptor drum 101 is not particularly limited to the above.

Charging roller 103 is a charging device of a contact type which uniformly electrifies the photoreceptor drum 101 surface at a predetermined potential. In the present embodiment, contact roller-type charging roller 103 is used as shown in FIG. 1, a charger of a corona discharging type or a brush type may be used instead of charging roller 103.

Developing unit 102 supplies toner to the photoreceptor drum 101 surface with an electrostatic latent image formed thereon to develop the latent image into a toner image. Developing units 102*a* to 102*d* store black, cyan, magenta and yellow color toners, respectively so as to develop the electrostatic latent images for colors formed on photoreceptor drums 101*a* to 101*d* into toner images of black, cyan, magenta and yellow colors.

Cleaning unit 104 removes and collects the toner remaining on the photoreceptor drum 101 surface after development and image transfer, using a lubricant or the like.

Intermediate transfer belt 11 arranged over photoreceptor drums 101 is wound and tensioned between a drive roller 11*a* and a driven roller 11*b*, forming a loop-like moving path. Arranged opposing outer peripheral surface of intermediate transfer belt 11 are photoreceptor drum 101*d*, photoreceptor drum 101*c*, photoreceptor drum 101*b* and photoreceptor drum 101*a* in the order mentioned. Primary transfer rollers 13*a* to 13*d* are arranged at positions opposing respective photoreceptor drums 101*a* to 101*d* with this intermediate transfer belt 11 sandwiched therebetween. The areas where intermediate transfer belt 11 opposes photoreceptor drums 101*a* to 101*d* form respective primary transfer stations. This intermediate transfer belt 11 is formed of an endless film of about 100 to 150 μm thick.

In order to transfer the toner images carried on the surfaces of photoreceptor drums 101*a* to 101*d* to intermediate transfer belt 11, each of primary transfer rollers 13*a* to 13*d* is applied by constant-voltage control at a primary transfer bias that has the opposite polarity to that of the charge on the toner. With this arrangement, the toner images of individual colors formed on photoreceptor drums 101 (101*a* to 101*d*) are successively transferred to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photoreceptor drums 101*a* to 101*d* electrostatic latent images and hence toner images are formed only for the photoreceptor drums 101 that correspond to the colors of the input image data. For example, upon monochrome image forming, the electrostatic latent image and toner image for photoreceptor drum 101*a* corresponding to black color are formed, so that the black toner image alone is transferred to the outer peripheral surface of intermediate transfer belt 11.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.,) coated on the shaft surface, and uniformly applies a high voltage to intermediate transfer belt 11 through the conducive elastic material. Though in the present embodiment, primary transfer rollers 13*a* to 13*d* are used as the transfer electrodes, brushes and the like can also be used in their place.

The toner image transferred to the outer peripheral surface of intermediate transfer belt 11 at each primary transfer station is conveyed as intermediate transfer belt 11 rotates to the secondary transfer station where the belt opposites secondary transfer roller 14. During image forming, secondary transfer roller 14 is abutted with a predetermined nip pressure against the outer peripheral surface of intermediate transfer belt 11, in the area where the interior side of intermediate transfer belt 11 comes into contact with the peripheral surface of drive roller 11*a*. In order to obtain constant nip pressure, either secondary transfer roller 14 or intermediate transfer belt drive roller 11*a* is formed of a hard material such as metal or the like while the other is formed of a soft material such as an elastic roller or the like (elastic rubber roller, foamed resin roller etc.).

When the paper fed from paper feed cassette 16 or manual paper feed tray 17 passes through the nip between secondary transfer roller 14 and intermediate transfer belt 11, a high voltage of a polarity (+) opposite to the polarity (−) of the electrostatic charge on the toner is applied to secondary transfer roller 14. In this way, the electrostatic latent images formed on photoreceptor drums 101 (101*a* to 101*d*) are visualized with the corresponding color toners, forming respective toner images, which are transferred to intermediate transfer belt 11 in a layered manner. Then the thus layered toner image is moved as intermediate transfer belt 11 rotates to the contact position between the paper being conveyed and intermediate transfer belt 11, so that the toner image is transferred from the outer peripheral surface of intermediate transfer belt 11 to the paper by means of secondary transfer roller 14.

Since the toner adhering to intermediate transfer belt 11 as the belt comes in contact with photoreceptor drums 101, or the toner which has not been transferred from intermediate transfer belt 11 to the paper during transfer of the toner image and remains on intermediate transfer belt 11, would cause contamination of color toners at the next operation, it is removed and collected by an intermediate transfer belt cleaning unit 12. Intermediate transfer belt cleaning unit 12 includes a cleaning blade, for example as a cleaning member that comes into contact with intermediate transfer belt 11. Intermediate transfer belt 11 is supported from its interior side by intermediate transfer belt driven roller lib, at the portion where this cleaning blade comes into contact with intermediate transfer belt 11.

The paper with the toner image as a visual image transferred thereon is lead to fuser unit 15 having a heat roller 15*a* and a pressing roller 15*b* and undergoes heating and pressing while passing through and between heat roller 15*a* and pressing roller 15*b*. Thereby, the toner image as a visual image is firmly fixed to the paper surface. The paper with the toner image fixed thereon is discharged by a paper discharge roller 18*a* onto paper output tray 18.

Image forming apparatus 100 includes a paper feed path P1 that extends approximately vertically to convey the paper from paper feed cassette 16 to paper output tray 18 by way of the nip between secondary transfer roller 14 and intermediate transfer belt 11 and fuser unit 15. Arranged along paper feed path P1 are a pickup roller 16*a* for delivering the paper from paper feed cassette 16, sheet by sheet into paper feed path P1, conveying rollers r10 for conveying the delivered paper upwards, a registration roller 19 for leading the conveyed paper to the nip between secondary transfer roller 14 and intermediate transfer belt 11 at a predetermined timing and paper discharge roller 18*a* for discharging the paper to paper output tray 18.

Image forming apparatus 100 also incorporates a paper feed path P2 that extends from manual paper feed tray 17 to registration roller 19, having a pickup roller 17*a* and conveying rollers r10 arranged therealong. There is also another paper feed path P3 that extends from paper discharge roller 18*a* toward the upstream side of registration roller 19 in paper feed path P1.

Paper discharge roller 18*a* is adapted to rotate in both forward and reverse directions, and is rotated in the forward direction to discharge the paper to paper output tray 18 at the time of one-sided image forming for forming an image on one side of the paper and at the time of the second side image forming in duplex image forming for forming images on both sides. On the other hand, at the time of the first side image forming in duplex image forming, paper discharge roller 18*a* is driven in the forward direction until the rear end of the paper passes by fuser unit 15 and then rotated in reverse while it is holding the rear end of the paper to lead the paper into paper feed path P3. Thereby, the paper with an image formed on one side thereof during duplex image forming is lead to paper feed path P1 with its printed face down and its front edge inverted to the rear.

Registration roller 19 leads the paper that has been fed from paper feed cassette 16 or manual paper feed tray 17 or that has been conveyed trough paper feed path P3, to the nip between secondary transfer roller 14 and intermediate transfer belt 11 at a timing synchronized with the rotation of intermediate transfer belt 11. For this purpose, registration roller 19 stops rotating when photoreceptor drums 101 and intermediate transfer belt 11 start operating while the paper that was started to be fed or conveyed in advance of rotation of intermediate transfer belt 11 is stopped from moving in paper feed path P1 with its front end abutting against registration roller 19. Thereafter, registration roller 19 starts rotating at such a timing that the front edge of the paper and the front end of the toner image formed on intermediate transfer belt 11 meet each other at the position where secondary transfer roller 14 and intermediate transfer belt 11 come in press-contact with each other.

Here, when full-color image forming is performed with all the image forming portions 55*a* to 55*d*, primary transfer rollers 13*a* to 13*d* are adapted to abut intermediate transfer belt 11 against respective photoreceptor drums 101*a* to 101*d*. On the other hand, when monochrome image forming is performed with image forming portion 55*a* alone, the primary transfer roller 13*a* alone is adapted to abut intermediate transfer belt 11 against photoreceptor drum 101*a*.

Figure 2:
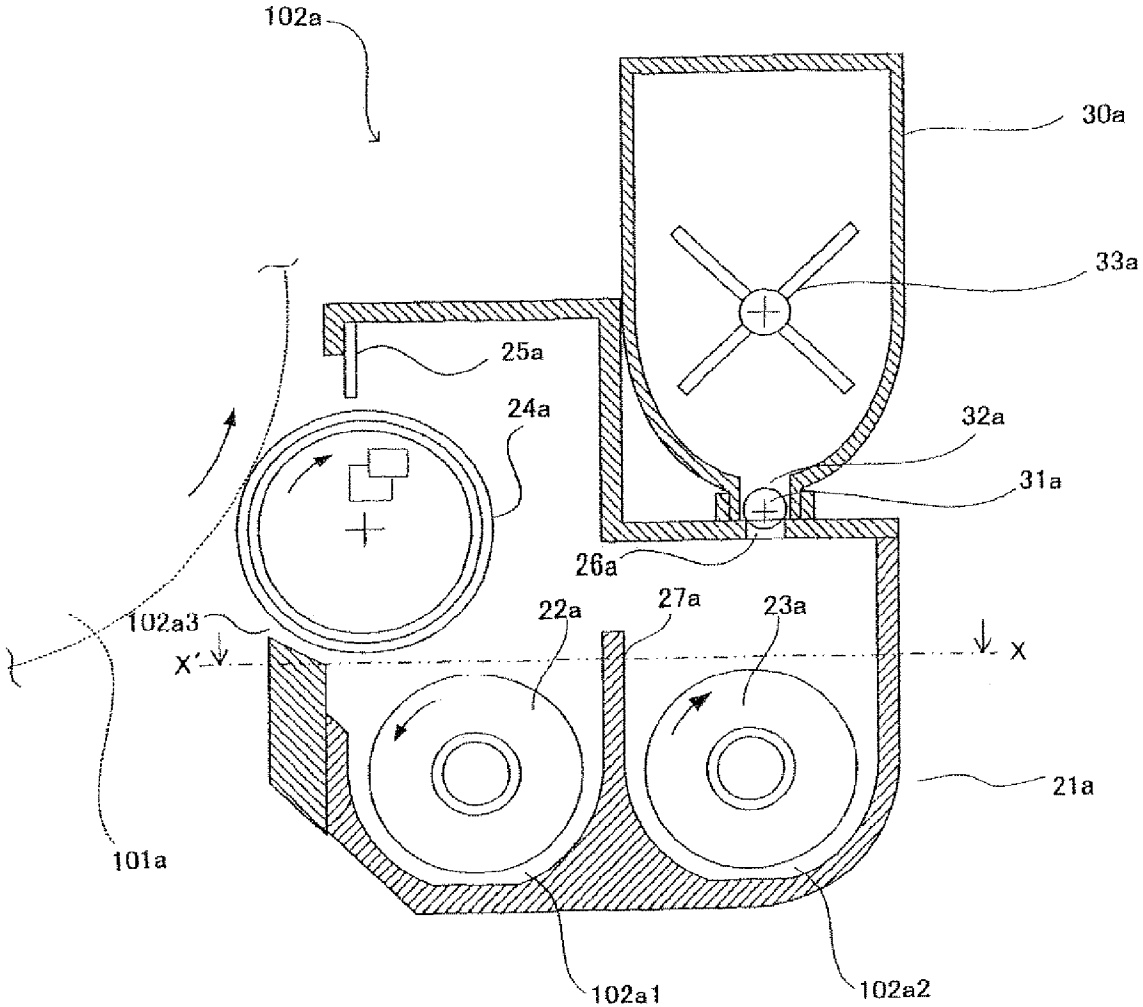
FIG. 2 is a vertical sectional view showing essential components of a developing unit provided for the image forming apparatus of the same embodiment and a toner supply device mounted for the developing unit.
Figure 3:
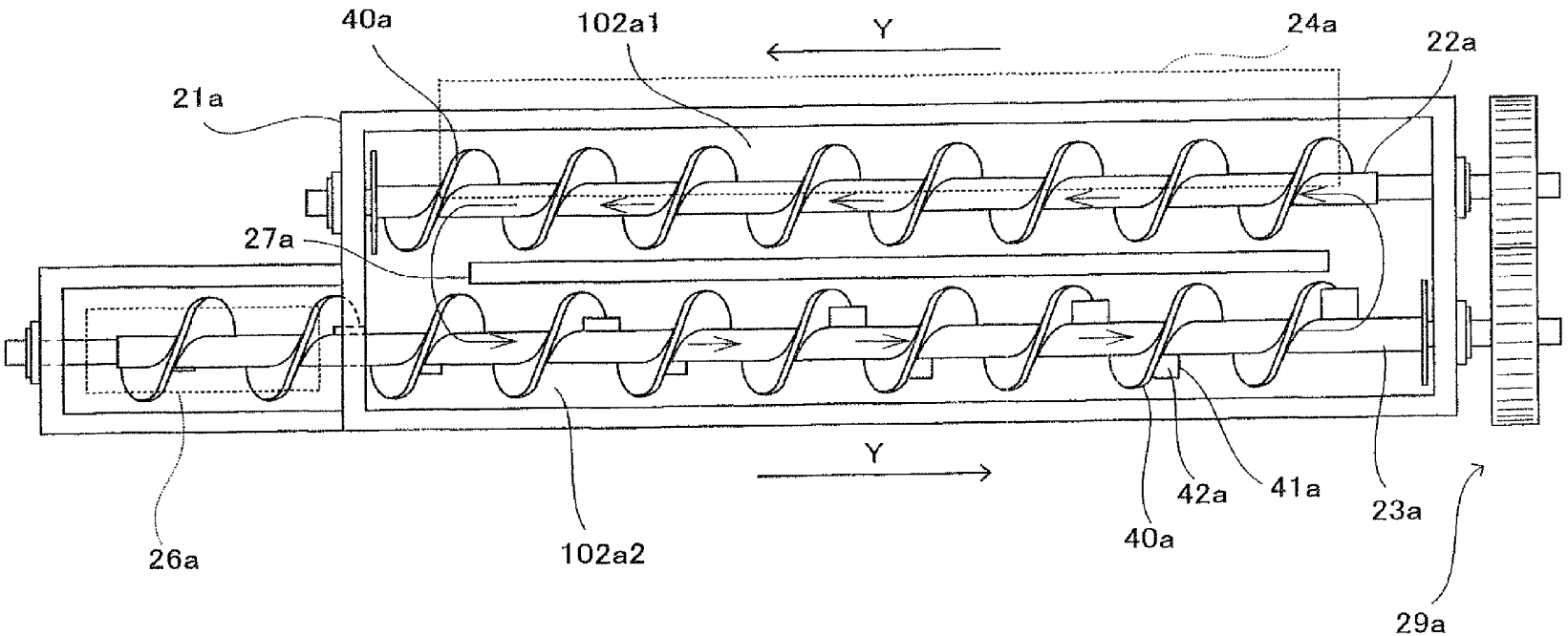
FIG. 3 is a sectional view cut along an X-X' plane in FIG. 2.

Next, the configuration of a developing unit provided for the image forming apparatus of the present embodiment will be described using the drawings. FIG. 2 is a vertical sectional view (side sectional view) showing essential components of a developing unit provided for the image forming apparatus of the present embodiment and a toner supply device mounted for the developing unit. FIG. 3 is a sectional view cut along an X-X' plane in FIG. 2. Here, the following description will be made on the developing unit for black, of all the developing units.

Black developing unit 102*a* includes a developer container 21*a* which holds a developer consisting of a carrier and toner therein and supplies the toner to photoreceptor drum 101*a* during image forming. Developing unit 102*a* also includes a pair of agitating rollers 22*a* and 23*a* functioning as agitators positioned inside developer container 21*a* and a developing roller 24*a* that forms a developing portion, a layer regulating member 25*a* and the like.

As shown in FIG. 2, developer container 21*a* has a toner supply port 26*a* at the top thereof for connection to a toner cartridge 30*a*. Developer container 21*a* also has an opening 102*a*3 that is located on the side opposing photoreceptor drum 101*a* and extends laterally in the axial direction of photoreceptor drum 101*a*.

A partitioning plate 27*a* is arranged between agitating rollers 22*a* and 23*a* inside developer container 21*a*, extending along the rollers with such a length that its ends do not reach the interior side walls of developer container 21*a* but are kept a predetermined distance apart from the interior side walls.

This partitioning plate 27*a* forms two hollowed compartments connected to each other at both their lateral ends, i.e., first agitating chamber 102*a*1 and second agitating chamber 102*a*2. This partitioning plate 27*a* is formed with a clearance from the top inner wall of developer container 21*a* so that the developer in second agitating chamber 102*a*2 will not flow over into first agitating chamber 102*a*1. Though in the present embodiment a clearance is formed between partitioning plate 27*a* and the top inner wall of developer container 21*a*, partitioning plate 27*a* may be joined to the top inner wall of developer container 21*a* without leaving clearance.

Agitating rollers 22*a* and 23*a* are rotational bodies having a spiral blade 40*a* and arranged with their axes aligned with the width direction of developer container 21*a*. Agitating roller 22*a* is disposed inside first agitating chamber 102*a*1 and agitating roller 23*a* is disposed inside second agitating chamber 102*a*2. Further, agitating rollers 22*a* and 23*a* are connected to each other by a series of gears 29*a* outside developer container 21*a* so that the rollers rotate in opposite directions.

As rotating, agitating rollers 22*a* and 23*a* agitate and convey the developer stored in first agitating chamber 102*a*1 and second agitating chamber, 102*a*2 in the direction of arrows Y (showing the directions of conveyance) to supply the developer to developing roller 24*a*. It should be noted that the developer is conveyed along the circulating conveying path around partitioning plate 27*a* inside first agitating chamber 102*a*1 and second agitating chamber 102*a*2 by rotation of agitating rollers 22*a* and 23*a* until the developer is supplied to developing roller 24*a*.

Developing roller 24*a* functions as a developer support to feed the developer containing electrostatic toner to photoreceptor drum 101*a*. This developing roller 24*a* is arranged such that its axis is parallel to the axes of agitating rollers 22*a* and 23*a* and part of it is exposed from opening 102*a*3 of developer container 21*a* to oppose photoreceptor drum 101*a* with a predetermined gap (distance) kept apart therefrom. Further, developing roller 24*a* is applied with an oscillating bias by an unillustrated bias voltage applicator which periodically changes in voltage between the developing potential that causes the toner to transfer from developing roller 24*a* to photoreceptor drum 101*a* and the inverse developing potential that causes the toner to transfer from photoreceptor drum 101*a* to developing roller 24*a*. Here, developing roller 24*a* rotates in the same direction as agitating roller 22*a* does.

Layer regulating member 25*a* is arranged a predetermined gap apart from the developing roller 24*a* surface so that the toner from developer container 21*a* will not adhere to developing roller 24 more than needed. Toner cartridge 30*a* includes a supply port 32*a* with supplying roller 31*a* and an agitating rotor 33*a* positioned therein, and is arranged over developer container 21*a* with its supply port 32*a* connected to toner supply port 26*a*. Toner cartridge 30*a* supplies the toner to developer container 21*a* through toner supply port 26*a* as supplying roller 31*a* rotates. Agitating rotor 33*a* agitates the toner stored inside toner cartridge 30*a*.

Figure 4:
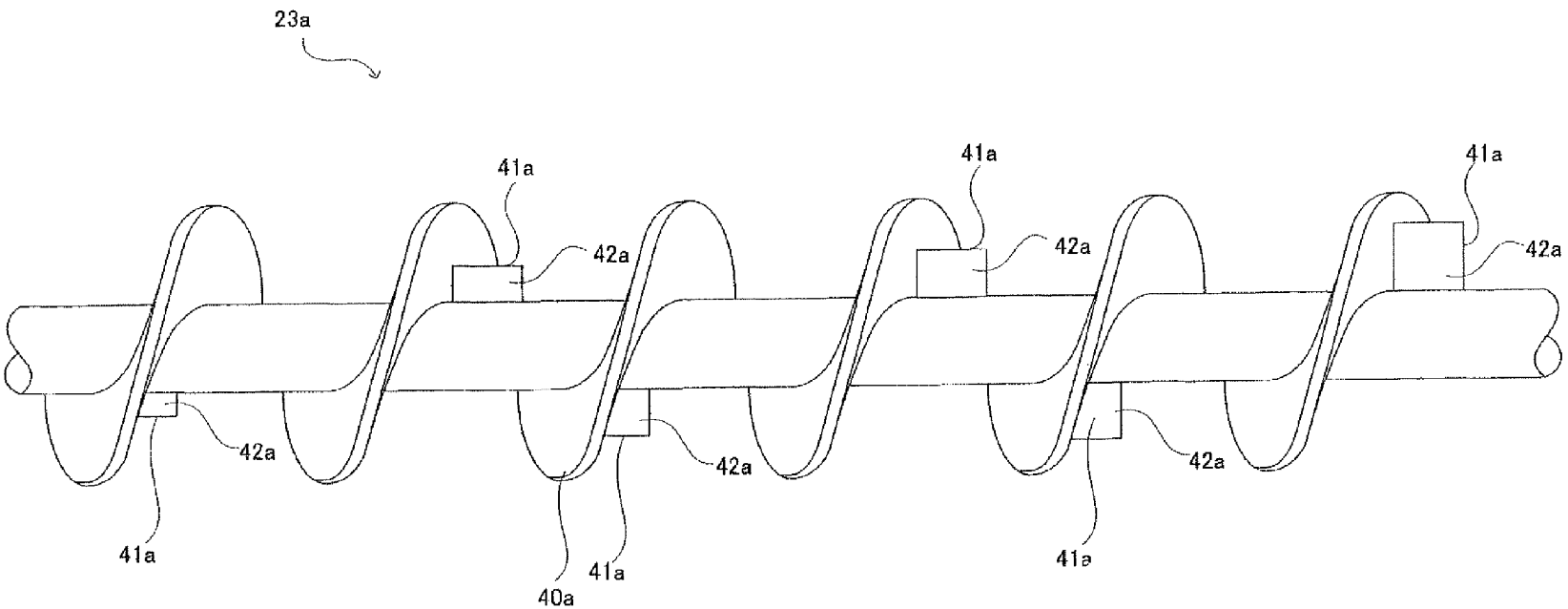
FIG. 4 is an enlarged external view showing an agitating roller provided for the developing unit of the same embodiment.
Figure 5:
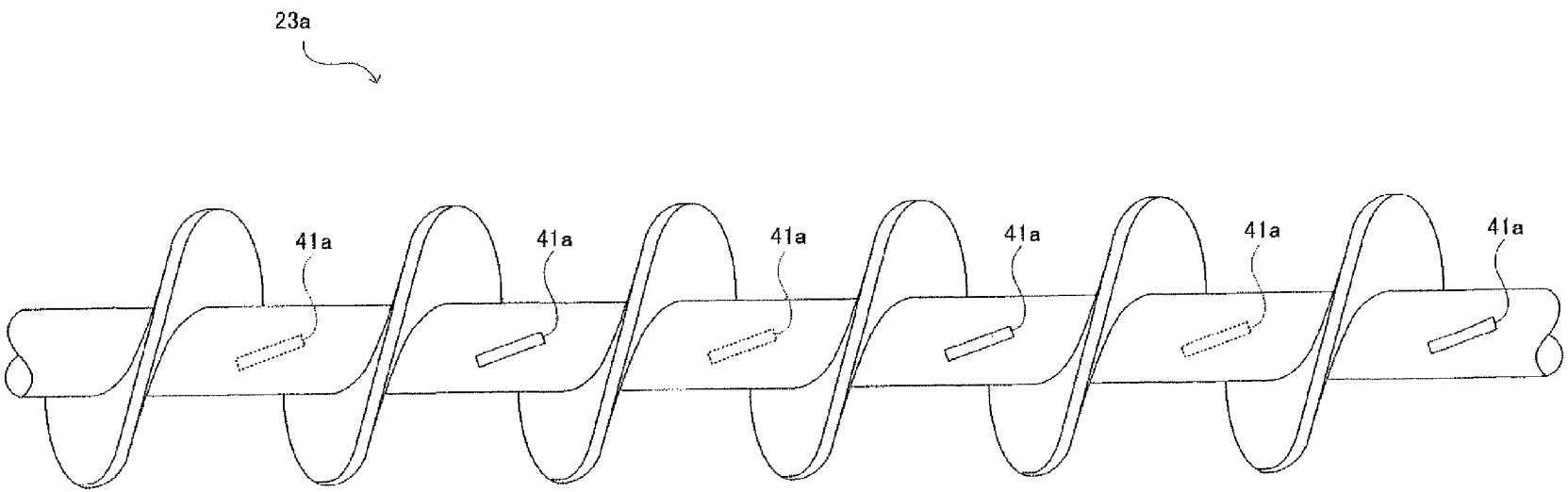
FIG. 5 is an enlarged external view showing a variational example of an agitating roller of the same embodiment.
Figure 6A:
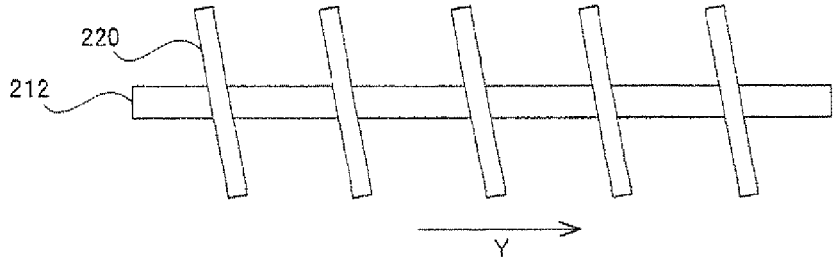
FIG. 6 is an external view showing examples for determining preferred conditions of arrangement of fins provided for the agitating roller of the same embodiment.
Figure 6B:
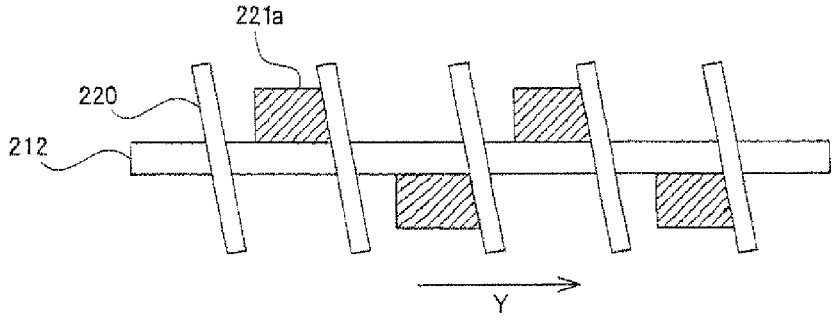
Figure 6C:
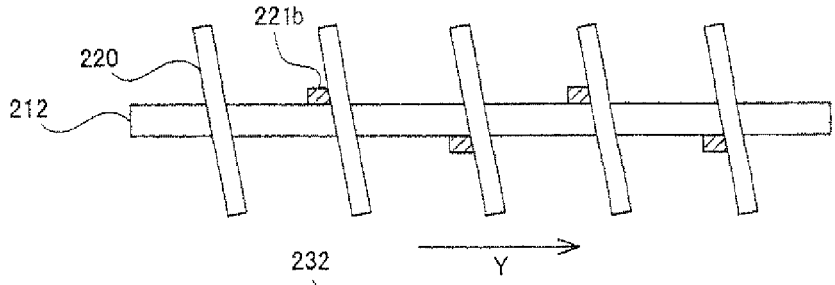
Figure 6D:
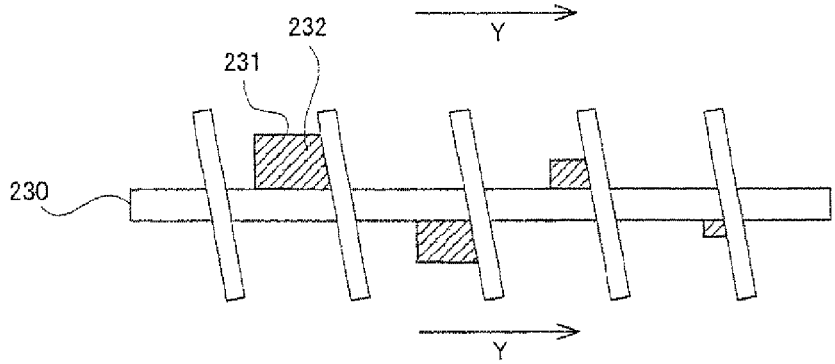

Next, the agitating rollers provided in the developing unit of the image forming apparatus of the present embodiment will be described with reference to the drawings. FIG. 4 is an enlarged external view showing an agitating roller provided for the developing unit of the present embodiment. FIG. 5 is an enlarged external view showing a variational example of the agitating roller. FIGS. 6A to 6E are external views showing examples for determining preferred conditions of arrangement of fins provided for the agitating roller. FIG. 7 is a table showing agitation performance and conveyance performance in each example shown in FIG. 6. Here, FIGS. 6A to 6E show different modes of fin arrangement, FIG. 6A showing a case in which no fin is provided for the agitating roller, wherein reference number 212 indicates an agitating roller and reference number 220 indicates a spiral blade; FIG. 6B a case in which fins 221*a* having a large-sized agitating face are arranged evenly; FIG. 6C a case in which fins 221*b* having a small-sized agitating face are arranged evenly; FIG. 6D a case in which the agitating face size of the fins becomes smaller the more downstream they are; and FIG. 6E a case in which the agitating face size of the fins becomes greater the more downstream they are they.

As shown in FIG. 4, agitating roller 23*a* has spiral blade 40*a* and fins 41*a*. These fins 41*a* are provided at plural positions on the rotational shaft of agitating roller 23*a* with their agitating face 42*a* positioned approximately parallel to the axial direction of agitating roller 23*a*, to agitate the developer in cooperation with spiral blade 40*a*. That is, fins 41*a* have the function of assisting agitation of the developer.

Figure 6E:
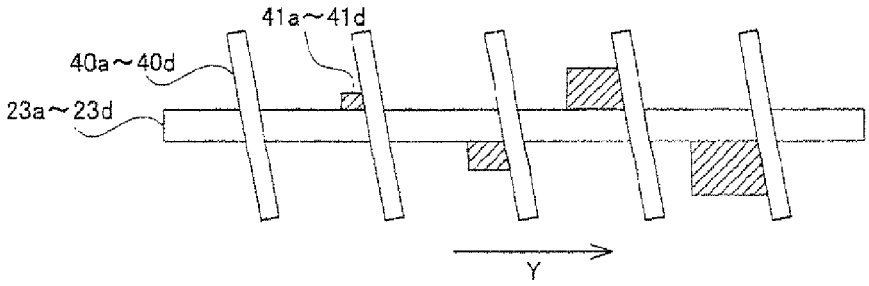

Further, in the present embodiment, these multiple fins 41*a* are specified so that the size of agitating face 42*a* becomes greater as fins 41*a* are located more downstream with respect to the direction of arrow Y that indicates the developer's direction of conveyance, as shown in FIG. 6E. The arrangement of fins 41*a* in the above way makes it possible to suppress degradation of the conveying performance of the developer and improve the agitation performance of agitating roller 23*a*, as the result shown in FIG. 7. As a result, it is possible to convey the developer at a suitable speed of conveyance while agitating the developer adequately even if the toner is small in size.

The greater the size of agitating face 42*a*, the better agitation performance fin 41*a* can present. However, usually the surface of the developer stored in development container 21*a* is located higher than the position of fin 41*a*. Accordingly, if the size of agitating face 42*a* is made greater, it takes some amount of time to sufficiently mix and agitate the added fresh toner that dropped on the developer surface with the developer. In addition, as the size of the agitating face 42*a* is greater, a greater force is needed to convey the developer in the rotational direction of agitating roller 23*a*. As a result it takes longer time to convey the developer, hence the conveyance performance becomes bad as understood from the case of FIG. 6B in the table in FIG. 7. Accordingly, it is effective that fins 41*a* having large-sized agitating faces 42*a* are used to agitate the developer that has been mixed and agitated to some degree with the added fresh toner that dropped on the surface of the developer, as in the present embodiment.

On the other hand, in contrast to the present embodiment, in the configuration of an agitating roller 230 having a plurality of fins 231 whose agitating faces 232 become smaller as they are located more downstream with respect to the direct ion of arrow Y shown in FIG. 6D, the conveyance performance can be secured to a certain degree as shown in FIG. 7. However, when a fin 231 having a large agitating face 232 is arranged on the upstream side with respect to the direction of arrow Y, it takes time to sufficiently agitate the fresh toner with the developer. Accordingly, the agitation performance can not be improved, resulting in agitation failure. Here, the arranged positions of fins 41*a*, the intervals of arrangement between the fins and the size of agitating faces 42*a* are preferably designated in consideration of the agitating performance, conveyance performance and other factors of spiral blade 40*a*.

Further, in the present embodiment, fins 41*a* are provided for agitating roller 23*a* only. This is because when the fresh toner dropped from toner supply port 26*a* is agitated and conveyed together with the developer to reach agitating roller 22*a* opposing developing roller 24*a*, the fresh toner and the developer has been sufficiently mixed by agitating roller 23*a*. That is, with no fin 41*a* provided for agitating roller 22*a*, the fresh toner dropped from toner supply port 26*a* has been sufficiently mixed with the developer. Thus, it is possible to suppress cost increase of agitating roller 22*a* while assuring agitation performance and conveyance performance. It is also possible to use an agitating roller 22*a* having fins 41*a*.

As shown in FIG. 4, fin 41*a* is formed so that the dimension of agitating face 42*a* along the radial direction of the rotational shaft of agitating roller 23*a* is smaller than the radial dimension of spiral blade 40*a*, so that it is possible to suppress reduction of the conveyance performance of the developer. Spiral blade 40*a* conveys and agitates the developer. If the dimension of agitating face 42*a* of fin 41*a* along the radial direction of the rotational shaft is greater than the radial dimension of spiral blade 40*a*, the performance of agitating the developer by fin 41*a* becomes so high that conveyance of the developer by spiral blade 40*a* is inhibited.

Further, provision of fins 41*a* on agitating roller 23*a* having screw-formed spiral blade 40*a* can improve the agitation performance of the developer with fins 41*a* more efficiently. That is, since each fin 41*a* is in opposition at an angle against the spiral direction because agitating face 42*a* is arranged approximately parallel to the axial direction of rotational shaft, at least part of the developer is conveyed in the spiral direction by spiral blade 40*a*, moving toward the agitating face 42*a*. As a result, fin 41*a* can easily trap the developer with agitating face 42*a*.

Though in the present embodiment, fins 41*a* are arranged with their agitating faces 42*a* approximately parallel to the axial direction of agitating roller 23*a*, the arrangement of fins is not particularly limited to this. For example, even if fins 41*a* are arranged inclined with respect to the axial direction as shown in FIG. 5, the same effect can be obtained.

Though description of developing unit 102 in the present embodiment was made referring to black developing unit 102*a*, the other developing units 102*b* to 102*d* have the same configurations, so that the same effect as above can be obtained.

Figure 8:
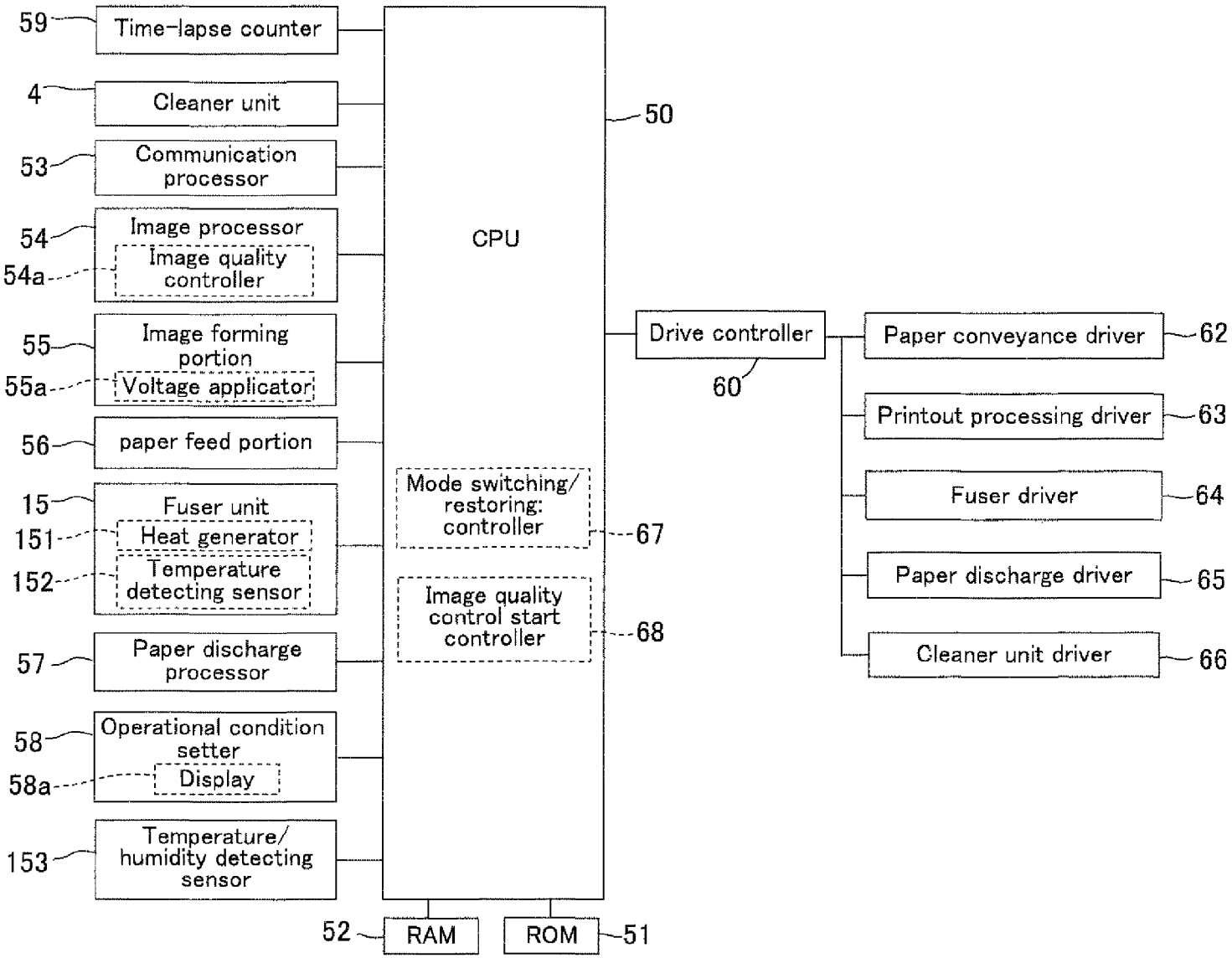
FIG. 8 is a block diagram showing a schematic electric architecture of an image forming apparatus of the same embodiment.

Next, the control system of the image forming apparatus according to the present embodiment will be described with reference to the drawings. FIG. 8 is a block diagram showing a schematic architecture of an electric controller of an image forming apparatus of the present embodiment.

As shown in FIG. 8, image forming apparatus 100 according to the present embodiment includes a central processing unit (CPU) 50 as the controller of the individual components provided for image forming apparatus 100, and the CPU executes the necessary processes such as image reading, image processing, image forming and sheet (recording paper) conveyance and the like in accordance with the program stored beforehand in ROM (read only memory) 51 using a temporal storage such as RAM (random access memory) 52 or the like. Here, a HDD (hard disk drive) or other storage may be used instead of ROM 51 and RAM 52.

In image forming apparatus 100, document image information transmitted from terminal devices connected via an unillustrated communication network is input to image processor 54 via a communication processor 53.

Image processor 54 processes the document image information stored in the storage such as RAM 52 or the like into printable images suitable for printing (image forming on the paper) in accordance with the aforementioned program. Further, in the present embodiment, image processor 54 also includes an image quality controller 54*a* as the image quality controller for controlling change in image quality of printout images such as changes in printed image quality and density, change in color and the like when image forming apparatus 100 recovers from sleep mode.

The printable image information obtained as a result of image processing at image processor 54 is input to image forming portions 55. Image forming portions 55, a paper feed portion 56 for performing various detections and controls in paper feed paths P1-P3 and the like, fuser unit 15 and paper discharge processor 57 for performing various detections and controls of the paper at paper discharge roller 18*a* are operated in linkage with a drive controller 60 for controlling associated drivers.

The paper conveyed by paper feed portion 56 undergoes a printing step for performing a printing process of image information through image forming portion 55 and a subsequent fusing step for performing a fixing process of the paper after the printing process, and then is discharged to paper output tray 18 as a paper discharge portion. In the present embodiment, fuser unit 15 includes a heat generator 151 for temperature control of the surface or the like of heat roller 15*a* and a temperature/humidity detecting sensor 152 for detecting the temperature and humidity of fuser unit 15 inclusive of heat roller 15*a*. Further, image forming apparatus 100 includes a temperature/humidity detecting sensor 153 located around the bottom or the like of image forming portion 55 to detect the atmospheric temperature and humidity inside the machine.

Image forming apparatus 100 also includes an operational condition setter 58. This operational condition setter 58 sets up the operational conditions for image forming, feed mode and the like in image forming apparatus 100, in accordance with the image forming request designated by the user through the control switches, etc., and in accordance with the image forming conditions such as the type of recording medium and the like. The operational condition setter 58 of the present embodiment further includes a display 58*a* for performing display for displaying a warning such as "please wait a little longer because of image quality control in progress" on a monitor, for example, when the amount of change of the developing potential that affects the force causing the toner to transfer from developing roller 24*a* to photoreceptor drum 101*a* exceeds a threshold, so as to be able to inform the user of the fact that some time is needed before printing.

Further, image forming apparatus 100, in accordance with the setup operational conditions, causes drive controller 60 to control the operations of the driving actuators for paper feed portion 56, image forming portions 55, fuser unit 15, paper discharge processor 57 and the like, namely, a paper conveyance driver 62, a printout processing driver 63, a fuser driver 64, a paper discharge driver 65 and a cleaner unit driver 66, in synchronism in accordance with the commands from CPU 54 based on the program stored in ROM 51.

Paper conveyance driver 62 is the actuator of paper feed portion 56, specifically including drive motors for pickup rollers 16*a* and 17*a* on the aforementioned paper feed paths P1 and P2 and registration roller 19. Printout processing driver 63 includes drive motors for photoreceptor drums 101. Fuser driver 64 includes a drive motor for heat roller 15*a* and pressing roller 15*b* in fuser unit 15. Paper discharge driver 65 includes a drive motor for paper discharge roller 18*a* and the like. Cleaner unit driver 66 includes a drive motor for a brush roller or the like provided for cleaner unit 104. These drive motors for these drivers may be constructed of appropriate power transmitting mechanisms using common or individual motors as their drive sources.

CPU 50 has a time-lapse counter 59 connected thereto as a timer or time counter for measuring the lapse time from the end of a printing operation in image forming apparatus 100. In the present embodiment, the operations of the aforementioned image quality controller 54*a*, a mode switching/restoring controller 67 for determination on switching between the standby mode and the power saving mode and recovery of image forming portion 55 and an image quality control start controller 68 for determination and control of starting image quality control of visual images by image quality controller 54*a*, are controlled based on the lapse time measured by this time-lapse counter 59.

Mode switching and restoring controller 67 has the function as a mode switch for switching image forming portion 55 from the standby mode in which image forming is instantly enabled into sleep mode as the power saving mode in which power supply to image forming portion 55 is partially stopped when lapse-time counter 59 reaches a predetermined time T1 from when image forming portion 55 was last operated without receiving any following command; and the function as a mode restoring portion for restoring image forming portion 55 from the sleep mode to the standby mode when a subsequent command is received.

Image quality control start controller 68 has the function of causing image equality controller 54*a* to start image quality control of visual images every time time-lapse counter 59 measures the lapse of a predetermined time T2 (T2>T1) from when image forming portion 55 was operated last. In the present embodiment, image quality control start controller 68 starts execution of image quality control before image forming portion 55 is recovered from sleep mode to standby mode by switching/restoring controller 67.

In this way, the image quality control for boosting up the image forming process in image forming portion 55 is effected in sleep mode, so that it is possible to start an image forming process immediately after recovery from sleep mode, hence shortening the time from recovery from sleep mode to the first printout. Further, since switching of image forming portion 55 into sleep mode, its recovery from sleep mode and operational instruction of image quality control can be performed based on time-lapse counter 59, it is possible to simply shorten the time after recovery from sleep mode until printout.

Also, in the present embodiment, image quality control start controller 68 has the function of reducing the predetermined time T2 for starting image quality control in accordance with various predetermined conditions in order to enhance the precision of image quality control and achieve more exact image quality control. Examples of the various predetermined conditions based on which the predetermined time T2 is shortened include a case in which the amount of change in developing potential exceeds a certain threshold and a case in which the amount of change in the surface temperature of heat roller 15*a* and/or the humidity during sleep mode exceeds a certain threshold. In this way, image quality control can be achieved while considering the electrostatic charge performance of the developer that has a large influence on image quality, or by appropriately grasping the condition under which the apparatus has been left during sleep mode, hence it is possible to effect exact image quality control more frequently.

Here, before describing the recovery operation of the image forming apparatus from sleep mode in the present embodiment, the reason why the conventional image forming apparatus needs image quality control when it recovers from sleep mode will be described. Recovery of the image forming apparatus from sleep mode means that the engine part of the image forming portion has been stopped before the recovery. This means that, in a case of a dual-component developing process for example, the developer has not been agitated and electrified for the time being. It is also considered that the environment or more specifically the temperature and humidity environment such as changes in temperature and humidity, under which the image forming apparatus is installed changes between day and night.

In this way, the amount of charge on the developer and the potential of the photoreceptor and other factors may change when the environmental conditions change. Usually, the change in environmental conditions brings about a change in printed image quality and density and/or a change in color. Accordingly, when the image forming apparatus recovers from sleep mode, the image quality control function provided for the image forming apparatus executes an image quality control process so as to secure the desired printed image quality and then outputs printed images. Specifically, image density adjustment on the high density side and/or adjustment on intermediate density is done to assure optimal printed image quality. The actual image quality adjustment in this case needs about 30 to 60 seconds.

Figure 9:
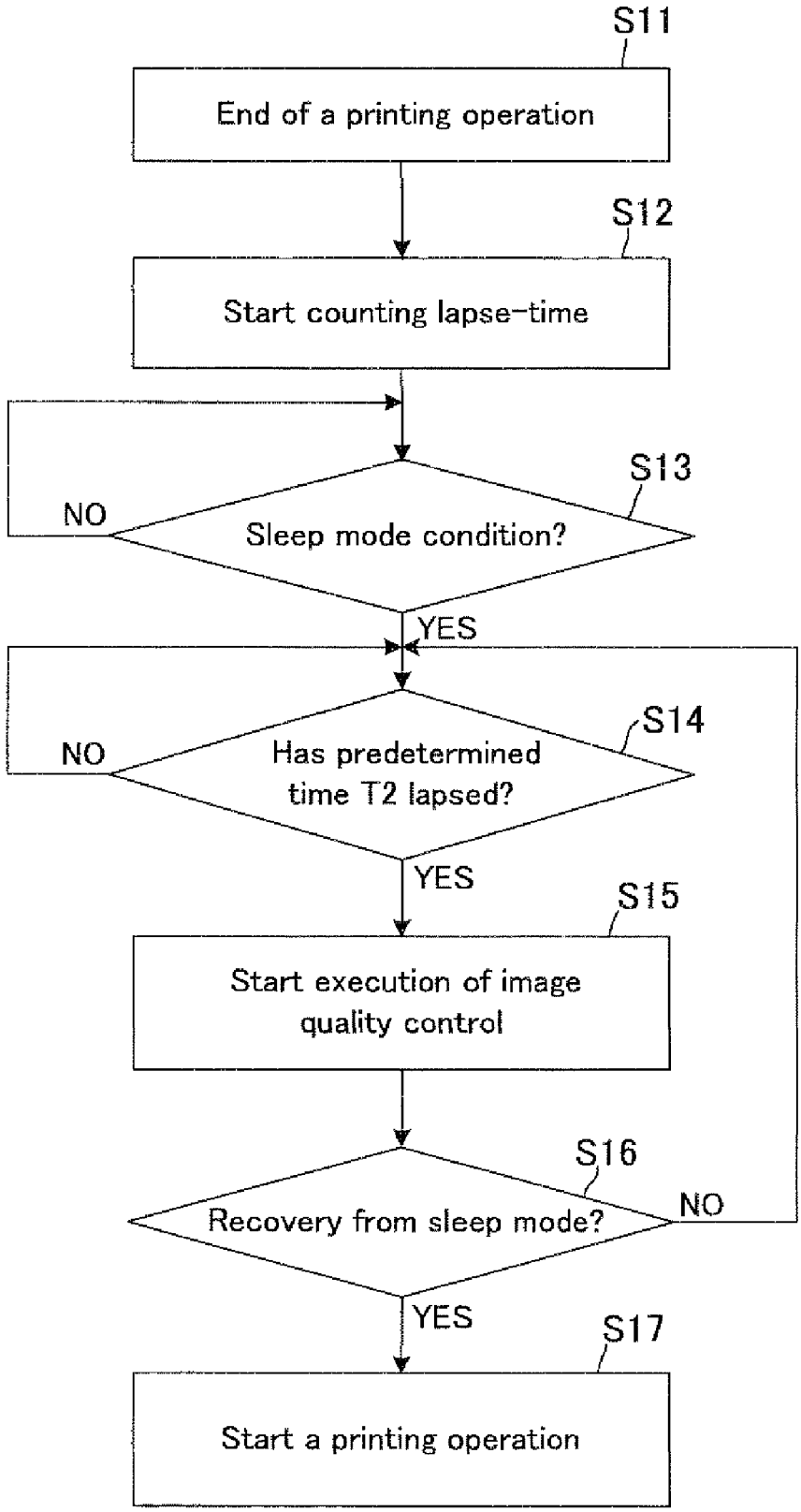
FIG. 9 is a flowchart for illustrating a recovery operation, from sleep mode, of an image forming apparatus of the same embodiment.

Next, the recovery operation from the sleep mode of the image forming apparatus of the present embodiment will be described with reference to the drawings. FIG. 9 is a flow chart for illustrating the recovery operation from the sleep mode of the image forming apparatus of the present embodiment.

To begin with, when a normal printing operation is ended (Step S11), photoreceptor drums 101 stop, and time-lapse counter 59 in image forming apparatus 100 starts counting the lapse time from the end of the printing operation (Step S12).

Then, if no subsequent command has been received even after predetermined time T1 elapsed from when the operation of image forming portion 55 ended, for example when image forming apparatus 100 has not been operated for 45 minutes, mode switching/restoring controller 67 of CPU 50 determines start of sleep mode and switches image forming portion 55 from the standby mode in which image forming is immediately enabled into the sleep mode as a power-saving mode in which power supply to image forming portion 55 is partially stopped (Step S13).

After entrance into sleep mode at Step S13, when a predetermined time T2, for example 120 minutes, has elapsed from when image forming portion 55 was last operated, or when time-lapse counter 59 reaches the predetermined time T2 (Step S14), image quality controller 54*a* starts execution of image quality control of visual images (Step S15). Thereafter, time-lapse counter 59 starts counting once again from when the image forming portion was last operated up to predetermined time T2 in the same manner. This execution cycle of image quality control on visual images from Steps S14 to S15 is repeated during sleep mode up to recovery from sleep mode, as shown in FIG. 9.

Then, when the apparatus receives a print command as an input command from an external device etc. during sleep mode, mode switching/restoring controller 67 causes image forming portion 55 to recover from sleep mode to standby mode (Step S16). Image forming apparatus 100 then executes the previous routine before a printing operation, such as raising the fixing temperature and the like, and starts a printing operation as usual (Step S17). Accordingly, in the present embodiment, a printing operation can be started immediately after recovery of image forming portion 55 from sleep mode, it is hence possible to shorten the time from recovery from sleep mode to start of a printing operation by about 30 to 60 seconds compared to the conventional configuration.

Here, the status of image forming when image forming portion 55 is recovered from sleep mode to standby mode by the command from mode switching/restoring controller 67 at Step S16 is set with the conditions of image quality control that were designated immediately before the recovery. In this way, image forming portion 55 can be refreshed as many times as possible by execution of image quality control during sleep mode before image forming portion 55 is recovered from sleep mode to standby mode, it is hence possible to further reduce the time to the first printout after recovery from sleep mode because a greater part of image quality control process can be omitted.

Since it takes a longer time to execute image quality control when the visual image formed by image forming portion 55 is a color image, image quality control start controller 68 effects image quality control on each visual image formed based on the image data corresponding to each of the separated colors of the full-color image, first and then mode switching/restoring controller 67 restores image forming portion 55 from sleep mode to standby mode. With this control, most of the time required for image quality control for full-color images, which needs a longer time compared to that for monochrome images, can be saved, it is hence possible to shorten the necessary time for image forming portion 55 from recovery from sleep mode to first printout to as low as the level for monochrome images.

Figure 10:
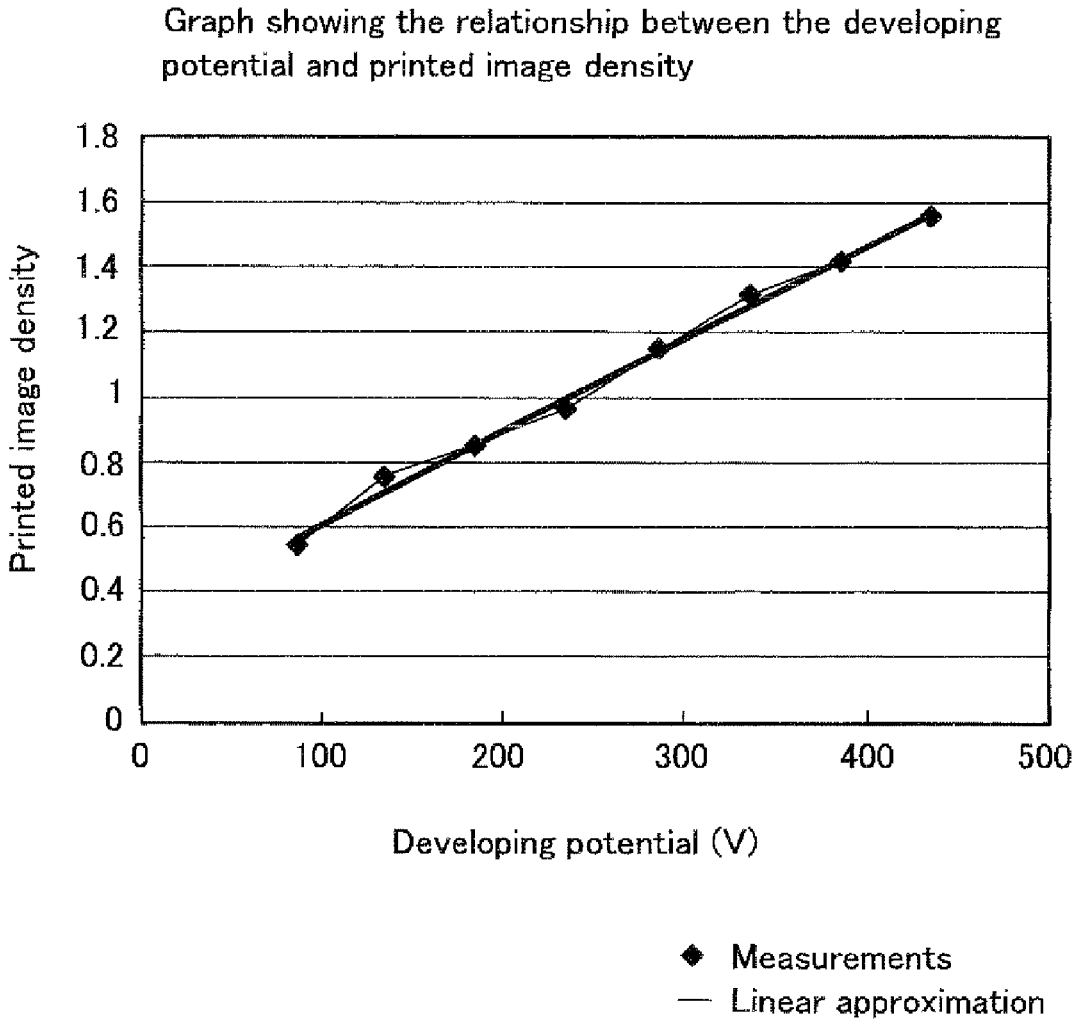
FIG. 10 is a chart showing the relationship between the developing potential and printed image density in the image forming apparatus of the same embodiment.

Here in the present embodiment, the relationship of the print density depending on the developing potential is approximately linear as shown in FIG. 10. An amount of change of 0.1 in print density, which is significant in terms of print density, corresponds to 35 V in terms of developing potential. Accordingly, if, in the image quality control during sleep mode in the present embodiment, a change in developing potential exceeds 35 V, it can be detected that a serious environmental change has occurred. Accordingly, the predetermined time T2 from the end of operation of image forming portion 55, which is the cycle for execution of image quality control during sleep mode, may be shortened from 120 minutes to 110 minutes, for example, so as to achieve more precise image quality control. Similarly, a conversion table as to temperature and humidity in fuser unit 15 and inside image forming apparatus 100 may be recorded beforehand in ROM or the like, so as to shorten the predetermined time T2 from the end of operation of image forming portion 55 based on the conversion table, whereby it is possible to achieve further precise image quality control.

Further, in the present embodiment, as described above, the predetermined time T2 for starting execution of image quality control is shortened depending on various predetermined conditions in order to improve precision of image quality control and achieve more exact image quality control. Specific examples of the various predetermined conditions for shortening the predetermined time T2 include a case where the amount of change in developing potential exceeds its threshold and a case where the amount of change in the surface temperature of heat roller 15*a* or the amount of change in humidity during sleep mode exceeds the associated threshold. In this way, image quality control can be achieved while considering the electrostatic charge performance of the developer that has a large influence on image quality, or by appropriately grasping the conditions under which the apparatus has been left during sleep mode, hence it is possible to effect exact image quality control more frequently.

The Second Embodiment

The configuration of the second embodiment of an image forming apparatus will be described with reference to the drawings. The configurations of the image forming apparatus, developing unit and agitating roller and the block diagram showing the schematic electric architecture of this embodiment are the same as those of the first embodiment so that description of these is omitted.

In the present embodiment, the recovery operation of the image forming apparatus from sleep mode is different. That is, the recovery operation from sleep mode is carried out in consideration of the fixing temperature at the fuser unit in the duration from the time the image forming portion is switched from standby mode to sleep mode to the time the image quality controller completes image quality control.

Figure 11:
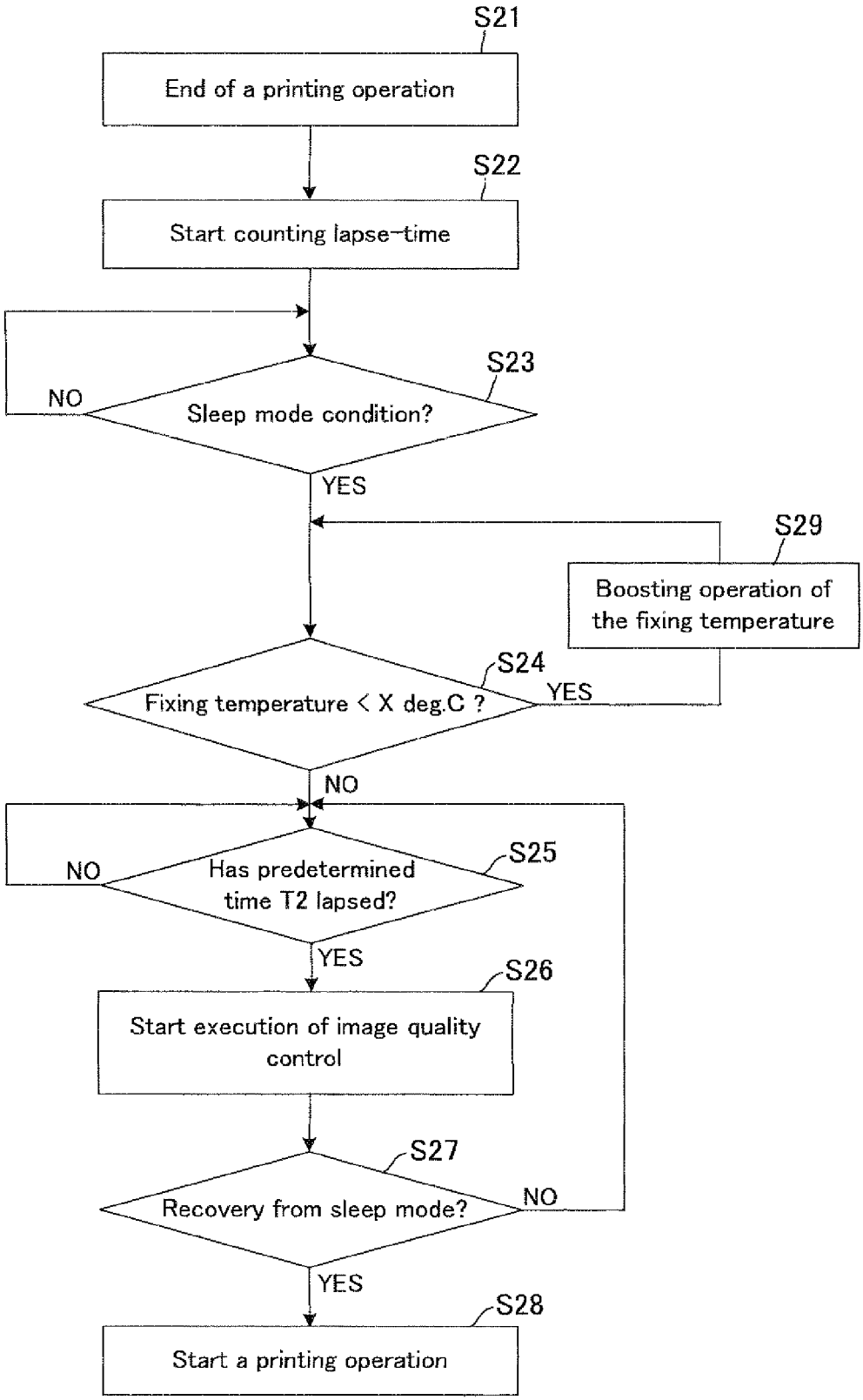
FIG. 11 is a flow chart for illustrating a recovery operation, from sleep mode, of an image forming apparatus of the second embodiment.

Next, the recovery operation from sleep mode in the present embodiment will be described with reference to the drawings. FIG. 11 is a flow chart for illustrating a recovery operation, from sleep mode, of an image forming apparatus of this embodiment.

To begin with, when a normal printing operation is ended (Step S21), photoreceptor drums 101 stop, and time-lapse counter 59 in image forming apparatus 100 starts counting the lapse time from the end of the printing operation (Step S22).

Then, if no subsequent command has been received even after predetermined time T1 elapsed from when the operation of image forming portion 55 ended, or if, for example, image forming apparatus 100 has not been operated for 45 minutes, mode switching/restoring controller 67 of CPU 50 determines entrance into the sleep mode and switches image forming portion 55 from the standby mode in which image forming is immediately enabled into the sleep mode as a power-saving mode in which power supply to image forming portion 55 is partially stopped (Step S23).

Though the same operation is carried out up to Step S23, in the present embodiment, after switching into sleep mode, it is determined by temperature/humidity detecting sensor 152 that is checking the fixing temperature of heat roller 15*a* of fusing unit 15, whether the fixing temperature lowers to, for example 60 deg. C. or below (Step S24). When the fixing temperature is detected to be 60 deg. C. or below at Step S24, then heat generator 151 or the like is automatically turned on so as to perform a boosting operation of the fixing temperature (Step S29).

This operation of raising the fixing temperature is carried out in order to prevent the need for extra time that would be taken to make the first printout, particularly upon a recovery from a sleep mode that has been continued for a long time because heat roller 15*a* of fusing unit 15 cannot be quickly restored to the predetermined fixing temperature. Since the influence on the image quality due to insufficiency of the fixing temperature can be suppressed, it is possible to perform the first printout in a reliable manner by inhibiting fixing failure of the visual image with toner.

After entrance into sleep mode at Step S23, while the fixing temperature is kept over the predetermined temperature (Step S29) by checking it at Step S24, when a predetermined time T2, for example 120 minutes, has elapsed from the time image forming portion 55 was last operated, or when time-lapse counter 59 reaches the predetermined time T2 (Step S25), image quality controller 54*a* starts execution of image quality control of visual images (Step S26), as the same manner as the first embodiment.

Thereafter, time-lapse counter 59 starts counting once again from when the image forming portion was last operated up to predetermined time T2 in the same manner. This execution cycle of image quality control on visual images from Steps S25 to S26 is repeated during sleep mode until the apparatus is recovered from sleep mode, as shown in FIG. 11.

Then, when the apparatus receives a print command as an input command from an external device etc. during sleep mode, mode switching/restoring controller 67 causes image forming portion 55 to recover from sleep mode to standby mode (Step S27) and start a printing operation (Step S28).

In this way, also in the present embodiment, a printing operation can be started immediately after recovery of image forming portion 55 from sleep mode as in the first embodiment, hence it is possible to shorten the time from recovery from sleep mode to start of a printing operation. Further, since the fixing temperature is controlled so as to be equal to or higher than the predetermined temperature before recovery from sleep mode, it is possible to cut down wastage of time up to the first printout. Since it is also possible to suppress the influence on the image quality due to insufficiency of the fixing temperature, it is possible to perform the first printout in a reliable manner by inhibiting fixing failure of the visual image with toner.

Having described the preferred embodiment modes with reference to the attached drawings, it goes without saying that the technology should not be limited to the above-described examples, and it is obvious that various changes and modifications will occur to those skilled in the art within the scope of the appended claims. Such variations are therefore understood to be within the technical scope of the technology.

For example, in each of the above embodiment modes, the technology was described based on the electrophotographic digital full-color copier as the image forming apparatus, but the technology should not be limited to electrophotographic, digital and/or color copiers. That is, the technology can be applied in the same manner to analog, monochrome, non-full color or limited-color printers, facsimile machines and the like using other image forming techniques such as ink-jet technologies etc.

For users that mostly use the image forming apparatus for printout in large volume, the program for executing the image quality control may be prepared as an optional medium separated from ROM 51 and RAM 52, so as take a form that can be installed into the image forming apparatus depending on the user's demand.

What is claimed is:

1. An image forming apparatus that can be operated in a plurality of power modes different in power consumption, comprising:

an image forming portion for forming a visual image in accordance with image data contained in an input command;

a controller for controlling the image forming portion, characterized in that the controller includes:

a mode switch for switching the image forming portion from a standby mode in which image forming is instantly enabled into a power-saving mode in which power supply to the image forming portion is partially stopped when no subsequent command has been received after a first predetermined time period has elapsed from when image forming portion was operated last;

a mode restoring portion for restoring the image forming portion from the power-saving mode to the standby mode when a subsequent command is received; and an image quality controller for performing image quality control of the visual image each time that a second predetermined time period elapses while the image forming portion is in the power-saving mode; and a fusing unit for fixing a visual image that was formed by the image forming portion and transferred to a recording medium, wherein a boosting operation for increasing a surface temperature of the fusing unit is performed in the fusing unit when the surface temperature of the fusing unit becomes equal to or lower than a predetermined temperature during the power-saving mode.

2. The image forming apparatus according to claim 1, wherein the mode switch, the mode restoring portion and the image quality controller are operated based on output data from a time counter that counts a length of a time period that elapses from when the image forming portion was last operated.

3. The image forming apparatus according to claim 1, wherein the status of image forming when the image forming portion is recovered from the power-saving mode to the standby mode by the mode restoring portion is set with the conditions that were designated for the image quality control immediately before the recovery.

4. The image forming apparatus according to claim 1, wherein, when the visual image formed by the image forming portion is a color image, the image quality controller effects image quality control on every visual image formed based on the image data corresponding to each of the separated colors of the color image, first and then the mode restoring portion restores the image forming portion from the power-saving mode to the standby mode.

5. The image forming apparatus according to claim 1, wherein the image forming portion comprises:

an image bearer on which a latent image is formed by a light exposure device;

a developer support for conveying a developer containing an electrostatically chargeable toner to the image bearer with a latent image; and a bias voltage applicator for applying an oscillating bias which periodically alternate a developing potential that causes the toner to transfer from the developer support to the image bearer and an inverse developing potential that causes the toner to transfer from the image bearer to the developer support, to the developer support, and wherein when an amount of change in the developing potential exceeds a threshold, the image quality controller shortens the second predetermined time period for start of performing the image quality control during the power-saving mode.

6. The image forming apparatus according to claim 5, further comprising a warning display portion for displaying a warning when an amount of change in the developing potential exceeds a threshold in the image quality control during the power-saving mode.

7. The image forming apparatus according to claim 1, wherein the fusing unit comprises:

a heat roller having a heat generator therein;

a pressing roller put in pressing contact with the heat roller; and a surface temperature detector for detecting the atmosphere inside the image forming apparatus and a surface temperature of the heat roller, and wherein when an amount of change in the surface temperature during the power-saving mode exceeds a threshold, the second predetermined time period for start of the image quality control is shortened.

8. The image forming apparatus according to claim 1, wherein the image forming apparatus further comprises a humidity detector for detecting humidity, and wherein the second predetermined time period for start of the image quality control is shortened when an amount of change in the humidity during the power-saving mode exceeds a threshold.

9. The image forming apparatus according to claim 1, wherein the image forming portion includes a developer unit that applies toner to an image bearing member, wherein a developing bias is used to cause toner to move from the developer unit onto the image bearing member, and wherein when the developing bias exceeds a threshold while the image forming portion is in the power-saving mode, a length of the second predetermined time period is shortened.

10. The image forming apparatus according to claim 1, wherein when a sensed physical value that affects image quality changes by more than a threshold amount while the image forming portion is in the power-saving mode, a length of the second predetermined time period is shortened.

* * * * *